United States Patent [19]

Cook

[11] Patent Number: 4,819,471

[45] Date of Patent: Apr. 11, 1989

[54] PILGER DIE FOR TUBING PRODUCTION

[75] Inventor: Charles S. Cook, Murrysville Boro, Pa.

[73] Assignee: Westinghouse Electric Corp., Pittsburgh, Pa.

[21] Appl. No.: 925,765

[22] Filed: Oct. 31, 1986

[51] Int. Cl.[4] ..... B21B 17/02; B21B 21/02

[52] U.S. Cl. ..... 72/214; 29/121.1; 29/130; 29/132; 72/208

[58] Field of Search ..... 72/208, 214; 29/132, 29/130, 121.1; 76/107 R, 101 R, DIG. 6

[56] References Cited

U.S. PATENT DOCUMENTS

| | | | |
|---|---|---|---|
| 2,129,683 | 9/1938 | Gontermann et al. | 29/132 |
| 2,745,777 | 5/1956 | Clarke, Jr. . | |
| 3,345,220 | 10/1967 | Haynes . | |
| 3,385,739 | 5/1968 | Damin . | |
| 3,661,656 | 5/1972 | Jarleborg . | |
| 3,837,931 | 9/1974 | Nemoto et al. . | |
| 3,849,079 | 11/1974 | Montuelle et al. . | |
| 3,929,523 | 12/1975 | Kinochi et al. . | |
| 3,997,370 | 12/1976 | Horvath, Jr. et al. | 29/132 X |
| 4,047,941 | 9/1977 | Wright . | |
| 4,054,448 | 10/1977 | Wright . | |
| 4,131,491 | 12/1978 | Joseph . | |
| 4,159,218 | 6/1979 | Chatfield et al. . | |
| 4,180,421 | 12/1979 | Joseph et al. . | |
| 4,184,352 | 1/1980 | Potapov et al. | 72/208 |
| 4,196,025 | 4/1980 | Davies . | |
| 4,232,096 | 11/1980 | Franzen et al. . | |
| 4,298,406 | 11/1981 | Brownlee et al. . | |
| 4,410,374 | 10/1983 | Urabe . | |
| 4,470,854 | 9/1984 | Nakamura . | |
| 4,495,002 | 1/1985 | Anello . | |
| 4,674,312 | 6/1987 | Cook | 72/208 |

FOREIGN PATENT DOCUMENTS

| | | | |
|---|---|---|---|
| 55-114872 | 8/1980 | Japan . | |
| 0013147 | 1/1982 | Japan | 29/132 |
| 0006959 | 1/1983 | Japan | 29/132 |
| 0116911 | 7/1983 | Japan | 29/132 |
| 0178110 | 10/1984 | Japan | 29/132 |

*Primary Examiner*—Robert L. Spruill
*Assistant Examiner*—Steven B. Katz

[57] ABSTRACT

A pilgering die for use in cold forming of tubular members is in the shape of a ring member having a groove in the outer periphery thereof and a bore therethrough, the die composed of at least two different alloy sections. The case or outer region of the die is formed from a first steel alloy which hardens by transforming to martensite under predetermined heat treating conditions while the core or inner region of the die is formed from a second steel alloy that does not transform to martensite under the heat treating conditions used to harden the case. A third alloy section of a material which hardens by martensite formation may be provided adjacent the bore through the die. Also, the second alloy section may be comprised of a steel alloy that has a higher thermal expansion rate than the thermal expansion rate of the first alloy section.

12 Claims, 2 Drawing Sheets

PILGER DIE FOR TUBING PRODUCTION

BACKGROUND OF THE INVENTION

The present invention relates to the cold forming or pilgering of tubular members and particularly to a die used in such processing.

In the fabrication of tubular cladding for use in fuel elements of nuclear reactors, such cladding is normally made by pilgering of zirconium alloy cylinders. A hot extruded tubular shape is reduced in cross-sectional dimensions, both in diameter and wall thickness, by multiple pilger reductions, generally at room temperature. The pilgering apparatus uses opposed dies which have a tapered groove on the die periphery in the working area. By reciprocating the opposed dies over the tube being worked, which tube is suported on an internal mandrel, cold reduction of the tube is effected. The process is incremental in that the tube to be reduced to a smaller wall thickness and diameter is fed axially a small amount over the mandrel followed by a rolling cycle of dies forward and back. At the end of each cycle, a length of smaller tubing is produced equal to the amount fed times the elongation produced by the reduction in cross-sectional dimensions.

A significant cost factor in this operation is the life of the pilger dies. Previous work has indicated that lower stress dies, such as those formed from AISI Type H13 steel alloy, typically fail by surface spalling similar to that in bearings due to the high compressive stresses normal to the groove surface. Higher hardness dies, such as those formed from Bofors SR 1855 tool grade steel with a hardness of about 58 Rockwell C, resist spalling failures. These higher stress dies fail, however, by cracking due to the cyclic tensile stresses produced in the surface of the die groove. These tensile stresses are produced by the resolution of the working stresses against the semicircular groove surface in the transverse direction with respect to the groove axis.

A number of approaches have been identified to deal with cyclic tensile stresses in pilger dies. One is to insure that a high hardness die, such as a Bofors SR 1855 tool steel die, is case hardened rather than through hardened. Case hardening has been shown to result in a compressive rather than tensile residual stress on the surface which serves to resist the operating tensile stresses in the die groove resulting in significantly higher die life. One method for assuring the presence of a hardened case is described in published Japanese Patent Application No. 55-114872 of Westinghouse Electric Corporation, the assignee of the present invention. As described therein, a "directional quenching" heat treating process for tool steels for pilger machines involved heating a pilger die to austenitizing temperature range, selectively removing heat from the die at predetermined faster rate in the direction of the desired case than the rate of removal of heat from the balance of the die, and thereafter tempering the die. The process as therein described produced Bofers SR 1855 or AISI 52100 tool steel dies which had a case hardness of between 53 to 63 Rockwell C hardness (Rc 53 to Rc 63), of about one-half to one inch thickness, with the balance of the die having a hardness of between 35 to 45 Rockwell C (Rc 35 to Rc 45).

Another approach to deal with tensile operating stresses in pilger dies includes allowing for elastic deflection under load to produce compressive stresses in the groove area. This approach is described in my co-pending U.S. application, Ser. No. 692,811 filed Jan. 18, 1985, and entitled "Pilgering Apparatus", assigned to the assignee of the present invention, which co-pending application issued as U.S. Pat. No. 4,674,312 on June 23, 1987 and is incorporated by reference herein. As described therein, a recess is provided on the inner periphery of a rotatable pilger die, having a groove on the outer periphery, such that the die is flexed by load applied and the tensile strength in the region of the groove is controlled by compressive stress produced by the flexing due to the presence of the recess.

Case hardening of pilger dies results in a compressive residual stress in the outer peripheral region of the die. Case hardening means that only a surface layer is hardened by the martensitic reaction in steel while the bulk of the die remains in the soft, untransformed condition. Residual stresses are a consequence of thermal contraction on cooling and the volume expansion produced by the martensitic hardening reaction. That is, during the quenching operation the rapid cooling on the surface results in the martensitic hardening reaction and thus volume expansion. As the interior of the die cools it can also transform to martensite (resulting therefrom in through hardening) and continue to cool and thermally contract. If the interior of the die also transforms to martensite, the accompanying volume expansion forces the already cooled and hardened surface to be displaced outwardly resulting in residual tensile stresses in the surface of the die. If the interior does not transform but continues to thermally contract, the acompanying contraction causes residual compressive stresses in the surface of the core and case. These two conditions have been shown to have a dramatic effect on pilger die life with very inferior die lives demonstrated in through hardened dies. Residual stress and thus die life and productivity is determined primarily by the change in volume in the interior or core during quenching. Whether core volume increases or decreases is currently determined by the heat treatment procedure.

SUMMARY OF THE INVENTION

A die for a pilgering apparatus for use in reducing a tube comprises a ring shaped member that consists of at least two steel alloy sections, a first alloy section extending from the periphery of the ring a distance beyond a groove formed in the ring for pilgering operations, but a minor distance of the ring thickness, with a second steel alloy section extending from the first alloy section to a bore formed through the die, the second alloy section comprising a major portion of the thickness of the die. The first steel alloy is composed of a hardened steel alloy which is hardened by transforming to martensite under predetermined heat treating conditions, while the second steel alloy is composed of a material that does not transform to martensite under the heat treating conditions used to harden the first steel alloy, such that the first steel alloy section, or case, of the die is composed of a steel alloy with the desired strength and hardness to resist high compressive operating stresses, while the second steel alloy section, or core, has characteristics necessary to produce the desired volume contraction resulting in desired residual compressive stresses in the case to resist the cyclic operating tensile stresses.

In one embodiment of the present invention, the first alloy section extends a distance up to about twenty-five percent of the thickness of the die while the second alloy section comprises the remainder of the die. In another embodiment, a third steel alloy section is provided which extends from the bore of the die to a point spaced from the first alloy section, the third alloy section composed of a hardened steel alloy which is hardened by transforming to martensite under the heat treating conditions used in hardening of the first alloy section, said third alloy section extending a distance up to about ten percent of the thickness of the die, while the second alloy section still comprises a major portion of the die.

A further embodiment of the present invention provides a die wherein the second alloy section is composed of a material that has a higher thermal expansion rate than the thermal expansion rate of the material which comprises the first steel alloy section, such that the volume contraction due on cooling is high, resulting in a further increase in residual compressive stresses in the case of the die.

DETAILED DESCRIPTION

The present dies are distinct from previous pilger dies wherein residual stress control, as hereinbefore described, involve a tool steel alloy of a single composition and controlling the cooling rate within the tool during heat treatment.

According to the present invention, a pilger die is composed of two steel alloy sections in order to control the volume change and thus residual stress during heat treatment. A first steel alloy is used for a first or outer radial section of the die, the case, which is different from the second steel alloy used for the second or inner radial section of the die, the core.

Figure 1:
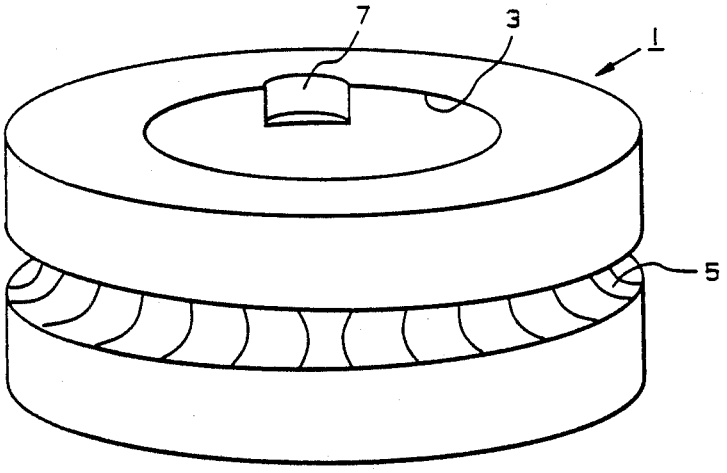
FIG. 1 is a schematic illustration of a pilgering die of the present invention.
Figure 3:
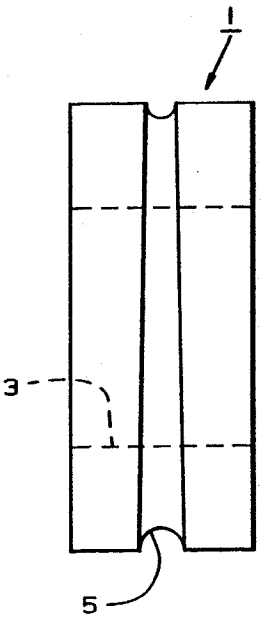
FIG. 3 is a view in side elevation of the die shown in FIG. 2.
Figure 2:
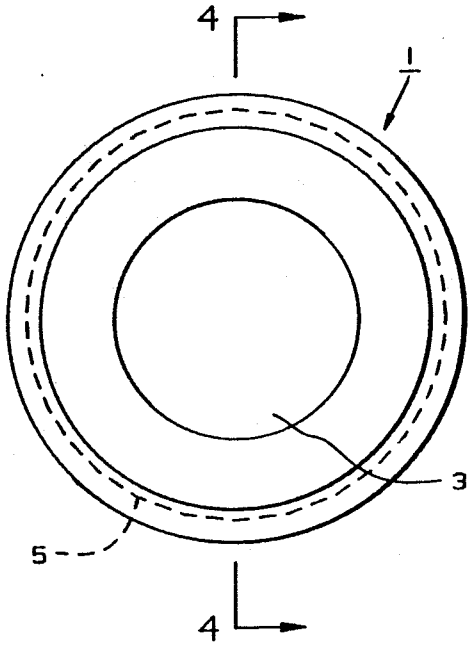
FIG. 2 is a plan view of the die of FIG. 1.

FIG. 1 illustrates a pilger die 1 which comprises an annular roll or ring having a bore 3 therethrough for mounting on a shaft. The outer periphery P of the ring has a tapered groove 5 of circular configuration therealong. The bore 3 has a keyway 7 for engagement of a key on a shaft upon which the die is to be mounted to suppress the tendency of the die to rotate relative to the shaft when the die is subjected to high pressure in operation. The transverse cross-section of the groove 5 at each position along the periphery of the die 1 is a circular arc, approximating a semi-circular arc. Over at least a portion of the periphery of the radius of the arc varies from a magnitude slightly greater than the starting OD of the tube to be reduced to a smaller magnitude slightly less than the OD of the tube following reduction. The groove extends beyond the taper from the smaller-radius end for an appreciable distance. This extension is called the "sizing area". The groove also extends from the largerradius end of the taper. At this end the radius of the groove is enlarged to prevent tube/tool contact and to facilitate and feeding rotation of the tube. The cylindrical surface of the die extending from the groove is called the tread and the sides of the die are called the flanks. The shape of the groove 5 is illustrated in FIGS. 1 to 3.

Figure 4:
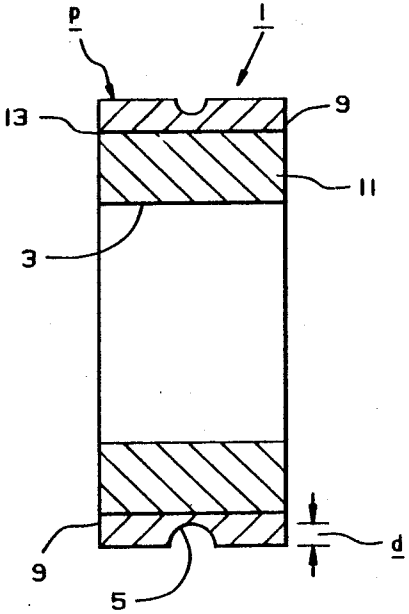
FIG. 4 is a view in longitudinal section taken along line 4—4 of FIG. 2.

As illustrated in the cross-sectional view of FIG. 4, the pilger die of the present invention consists of at least two steel alloys. A first alloy section 9 is composed of a hardened first steel alloy that is transformed to martensite under predetermined heat treating conditions. This section of hardened steel alloy extends from the outer periphery inwardly towards the bore 3 of the die beyond the predetermined distance d of the groove 5 to a point 13 spaced from the bore 3. The second alloy section 11 is composed of a second steel alloy that does not transform to martensite when exposed to the heat treating conditions needed to transform the first alloy to martensite. By utilizing a die which consists of two alloy sections, a control of the volume change and thus residual stress during heat treatment is effected. A second steel alloy is selected for section 11 or the core of the die which differs from the first steel alloy for section 9 or case of the die to obtain desired volume contraction during te heat treatment quench or cool down of the die which effect hardening of the case or first alloy section of the die. Thus, the case or first section 9 is still composed of a tool steel alloy with the desired strength or hardness to resist the high compressive operating stresses on the die during pilgering operations. The second alloy section or core, however, is composed of an alloy with the characteristics necessary to produce the desired volume contraction resulting in the desired residual stresses in case to resist the cyclic operating tensile stresses which occur during a pilgering operation.

The second alloy selected for the second section 11 or core of the die can be a steel alloy similar to that of the first section 9 or case except that its chemical composition (i.e. low carbon content) would prevent the martensite hardening reaction and thus guarantee volume contraction in the second section or core on quenching and a residual compressive stress in the first section or case of the die.

For example, the first alloy section, or case, could be formed from a high strength tool steel, such as Bofars SR 1855 which has the following nominal composition in weight percent:

Carbon—0.95
Manganese—0.9
Silicon—1.5
Chromium—1.1
Iron—Remainder or a similar Bofors high strength tool steel. Another suitable such steel is AISI-52100. AISI-52100 has the following nominal composition in weight percent:

Carbon—1.0
Manganese—0.4
Silicon—0.3
Chromium—1.45
Iron—Remainder

These compositions and others useful would have compositions, by weight, which typically comprise about 1 percent carbon, up to about 1 percent manganese, up to about 1.5 percent silicon, about 1 to 1.5 percent chromium and the remainder iron with the usual incidental impurities. Or, the first section could be formed from AISI-A8 which has the following nominal composition in weight percent:

Carbon—0.53–0.58
Manganese—0.25–0.35
Silicon—0.85–1.10

Chromium—4.80–5.10
Tungsten—1.00–1.50
Molybdenum—1.00–1.50
Iron—remainder

The first alloy section 9 or case of the die should be hardenable to a value between 53 to 63 Rockwell C (53 Rc to 63 Rc) and preferably of about 56 Rc to 58 Rc.

The second alloy or core of the die could be formed of a nonmartensite forming steel alloy such as a low carbon steel alloy, for example AISI-1020 which contains about 0.2 percent or less carbon. The low carbon content would prevent the martensite hardening reaction. The hardness of the second alloy section 11 or core of the die should be a value between 35 Rc to 45 Rc, and preferably about 38 Rc to 45 Rc.

In order to provide sufficient core material, in accordance with the present invention, the core material or second alloy must be a major portion of the thickness of the die. The case material or first alloy section should thus extend a minor distance from the outer periphery P to the bore 3 of the die but must extend deeper than the groove 5. The first alloy section, as aforedescribed, must extend beyond the groove 5 of the die but extend only a minor distance from the periphery P to the bore 3, of the die and preferably, the first alloy section extends from said periphery a distance of up to about 25 percent of the thickness of the die to assure the presence of a major portion of said second alloy, or core, in the die.

The dimensions of such a die for pilgering Zircaloy tubes, in a final reduction operation on a tube from an outer diameter of 0.7 inch and to a tube having an outer diameter of 0.375 inch and wall thickness of 0.023 inch, would be a die having a diameter of about 8 inches with a central bore of about 4.5 inches in diameter for securement to a rotatable shaft. The ring member thus would have a thickness of about 1.75 inches. The die would be about 3 inches wide, with the groove therein about 0.35 inches deep, at its deepest point. The thickness of the first section or case would be at least about 0.6 inch, or about 0.25 inch deeper than the groove. Such a die is that illustrated in FIG. 4.

Figure 5:
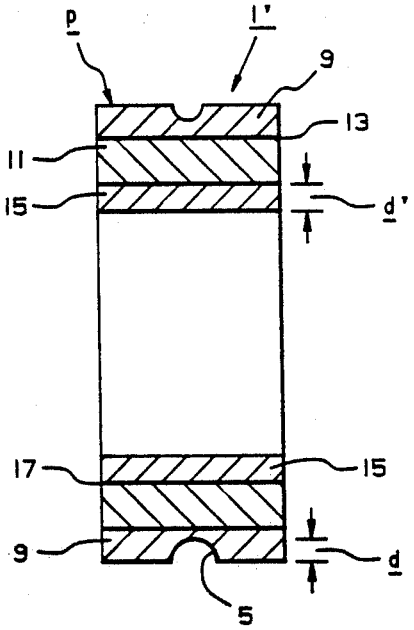
FIG. 5 is a view similar to that of FIG. 4 illustrating another embodiment of the die of the present invention.

In another embodiment of the present invention, as illustrated in FIG. 5, a third alloy section 15 is provided at the bore 3 of the die, in addition to the first and second alloy sections. In this embodiment, a hardenable alloy which is hardenable to martensite under predetermined heat treating conditions is provided at the periphery P of the die and at the bore 3, with the second alloy section therebetween composed of a non-hardenable alloy comprised of material that does not transform to martensite when exposed to said predetermined heat treating conditions. As illustrated, the die 1' comprises an annular ring having a bore 3 with a groove 5 in the outer periphery P thereof. A first alloy section 9 of a hardened steel alloy that is transformed to martensite under predetermined heat treating conditions extends from the outer periphery, beyond the depth d of the groove 5, to a point 13 spaced from the bore 3. A third alloy section 15 is also composed of a hardened steel alloy that is transformed to martensite under the predetermined heat treating conditions, and extends from the bore 3, a distance d' to a point 17 spaced from the first alloy section. The second steel alloy section 11 is composed of the second steel alloy that does not transform to martensite when exposed to the heat treating conditions needed to transform the first alloy and the third alloy to martensite. Thus, a non-hardenable steel alloy having a hardness of between about 35 Rc to 45 Rc is sandwiched between a first alloy section or case and a third alloy section or bore, the latter two alloys having a hardness of 53 Rc to 63 Rc.

In the embodiment wherein a third alloy section 13 is present in the die, adjacent the bore, the dimensions of the die would be the same as those described with respect to FIG. 4, except that the third alloy would be present and have a thickness of about 10 percent of the thickness of the ring member (1.75 inch) or a thickness of about 0.175 inch. Thus, the first alloy section must extend from the periphery P beyond the groove 5, a distance up to about 25 percent of the thickness of the die, while the third alloy section must extend from the bore 3 of the die a distance up to about 10 percent of the thickness of the die, with the second alloy section extending for a major portion of the die. Such a die is that illustrated in FIG. 5.

In both instances, the core or second alloy section 11 is greater in thickness than the first alloy section or the total of the first alloy section and third alloy section, such that the second alloy section comprises a major portion of the thickness of the ring member of the die.

In a further embodiment of the present invention, said second alloy section is composed of a steel alloy that does not transform to martensite under heat treating conditions for the first alloy section or the third alloy section and, in addition, has a higher thermal expansion rate than the thermal expansion rate of the steel alloy that comprises said first alloy section or the third section. Thus, the volume contraction of the second alloy section, due on cooling of the heat treated die, is high, resulting in a further increase in residual compressive stresses in the first alloy section or case of the die. For example, the first alloy section could comprise AISI-52100 which has a thermal expansion coefficient of $6.9\times10^{-6}$/°F. (room temperature to 200° F.), or AISI-A8 which has a thermal expansion coefficient of $6.6\times10^{-6}$/°F. (room temperature to 200° F.), while the second alloy section would be comprised of a steel alloy such as AISI-304 Stainless Steel, which has a thermal expansion coefficient of $9.4\times10^{-6}$/°F. (room temperature to 200° F.).

The multi-alloy pilger dies of the present invention may be produced by known metallurgical techniques. The fundamental requirements in this formation is to achieve a metallurgical bond between two alloy sections, since a mechanical shrink fit would not result in sufficient bond strength to survive heat treatment and operation. Also, potentially detrimental reactions between two alloys such as that produced by carbon diffusion from a tool steel to a steel such as stainless steel can be prevented by using a nickel interlayer at the bond interface.

Two known approaches for formation of the present novel dies would be hot isotactic pressing and hot extrusion, although other approaches would be available. In hot isotactic pressing, an assembly consisting of the core steel alloy section would be inserted into a case steel alloy section. in order to produce the desired bond by hot isotactic pressing, a seal weld on the two sides of the die at each end of the interface between each alloy section would be required in order to allow the necessary pressure differential to be developed. Bonding could be successfully achieved by exposing the assembly to about 2000° F. at 20,000 psi gas pressure for a two hour period. By hot extrusion, the alloy steel sections would be bonded to each other during the hot extrusion at approximately 2000 degrees F. of a billet assembly consisting of components of each alloy in the appropriate size, amount, and configuration. Since hot extrusion is basically a means for producing a significant reduction in billet cross section area, the total cross sectional area of the billet and that of each steel alloy section before hot extrusion must, therefore, be larger by the ratio of cross section area reduction being performed. In order to protect the interfaces to be bonded from contamination during heating before hot extrusion, seal welding at the periphery of each interface or vacuum encapsulation of the entire billet in a surrounding can would probably be necessary. This operation would be conducted earlier in the production sequence and would entail the normal operation such as forging to achieve the final dimensions for a pilger die blank.

The pilger dies of the present invention would have a higher residual compressive strength in the groove area relative to existing dies and thus provide a significantly higher productivity for the die. Also, such dies would be easier to heat treat since insulation procedures now used in current directional quenching procedure to guarantee a hardened case would not be needed.

What is claimed is:

1. A die for a pilgering apparatus for reducing a tube, said die comprising a ring-shaped member capable of being rotated and having along the outer periphery thereof a generally circular groove extending into said member a predetermined distance, whose transverse cross section is a generally circular arc decreasing progressively from a first point along said outer periphery to a second point along said outer periphery, said member having an internal bore for supporting said member on a shaft, said ring shaped member consisting of at least two steel alloy sections, a first steel alloy section comprising a hardened steel alloy having a hardness of 53 to 63 Rockwell C, hardened by transforming to martensite under predetermined heat treating conditions, extending from said outer periphery a distance inwardly beyond the predetermined distance of said groove and up to about 25 percent of the thickness of said die, to a point spaced from said bore, and a second steel alloy section having a hardness of 35 to 45 Rockwell C, comprising a major portion of said die, extending from said point to said bore, said second steel alloy composed of a material that does not transform to martensite when exposed to said heat treating conditions used to harden the first alloy section.

2. A pilger die for a pilgering apparatus for reducing a tube as defined in claim 1 wherein said first alloy section has a hardness of 56 to 58 Rockwell C.

3. A die for a pilgering apparatus for reducing a tube as defined in claim 1 wherein said second alloy section is comprised of a material having a higher thermal expansion rate than the thermal expansion rate of the material which comprises said first alloy section.

4. A die for a pilgering apparatus for reducing a tube as defined in claim 3 wherein said first steel alloy is selected from the group consisting of AISI-A8 and AISI-52100, and said second steel alloy is AISI-304 stainless steel.

5. A die for a pilgering apparatus for reducing a tube, said die comprising a ring-shaped member capable of being rotated and having along the outer periphery thereof a generally circular groove extending into said member a predetermined distance, whose transverse cross section is a generally circular arc decreasing progressively from a first point along said outer periphery to a second point along said outer periphery, said member having an internal bore for supporting said member on a shaft, said ring shaped member consisting of three steel alloy sections, a first steel alloy section comprising a hardened steel alloy, hardened by transforming to martensite under predetermined heat treating conditions, extending from said outer periphery a distance inwardly beyond the predetermined distance of said groove to a point spaced from said bore, a second steel alloy section, comprising a major portion of said die, extending from said point towards said bore, said second steel alloy composed of a material that does not transform to martensite when exposed to said heat treating conditions used to harden the first alloy section, and a third steel alloy section extending from said bore to a point spaced from said first alloy section, said third alloy section comprising a hardened steel alloy, hardened by transforming to martensite under said predetermined heat treating conditions.

6. A die for a pilgering apparatus for reducing a tube as defined in claim 5 wherein said first steel alloy section extends from the periphery of said die a distance up to about 25 percent of the thickness of said die and said third steel alloy section extends from the bore of said die a distance of up to about 10 percent of the thickness of the die.

7. A die for a pilgering apparatus for reducing a tube as defined in claim 5 wherein said first alloy section and said third alloy section are composed of a steel alloy of the same composition.

8. A die for a pilgering apparatus for reducing a tube as defined in claim 5 wherein said first steel alloy is selected from the group consisting of a high strength tool steel having up to 1 percent carbon, up to 1 percent manganese, up to 1.5 percent silicon, about 1 to 1.5 percent chromium, and the remainder iron, by weight.

9. A die for a pilgering apparatus for reducing a tube as defined in claim 8 wherein said second steel alloy is a low carbon steel alloy containing about 0.2 percent or less carbon.

10. A die for a pilgering apparatus for reducing a tube, said die comprising a ring-shaped member capable of being rotated and having along the outer periphery thereof a generally circular groove extending into said member a predetermined distance, whose transverse cross section is a generally circular arc decreasing progressively from a first point along said outer periphery to a second point along said outer periphery, said member having an internal bore for supporting said member on a shaft, said ring shaped member consisting of at least three steel alloy sections, a first steel alloy section comprising a hardened steel alloy having a hardness of 53 to 63 Rockwell C, hardened by transforming to martensite under predetermined heat treating conditions, extending from said outer periphery a distance inwardly beyond the predetermined distance of said groove and up to about 25 percent of the thickness of said die, to a point spaced from said bore, a second steel alloy section having a hardness of 35 to 45 Rockwell C, comprising a major portion of said die, extending from said point towards said bore, said second steel alloy composed of a material that does not transform to martensite when exposed to said heat treating conditions used to harden the first alloy section, and a third steel alloy section extending from said bore to a point spaced from said first alloy section, said third alloy section comprising a hardened steel alloy, hardened by transforming to martensite under said predetermined heat treating conditions.

11. A die for a pilgering apparatus for reducing a tube as defined in claim 10 wherein said third steel alloy section extends from the bore of said die a distance of up to about 10 percent of the thickness of the die.

12. A die for a pilgering apparatus for reducing a tube as defined in claim 10 wherein said first alloy section and said third alloy section are composed of a steel alloy of the same composition.

* * * * *